US009009934B1

(12) United States Patent
Eckhart

(10) Patent No.: US 9,009,934 B1
(45) Date of Patent: Apr. 21, 2015

(54) POSITIONER

(71) Applicant: Mike Eckhart, Maquoketa, IA (US)

(72) Inventor: Mike Eckhart, Maquoketa, IA (US)

( * ) Notice: Subject to any disclaimer, the term of this patent is extended or adjusted under 35 U.S.C. 154(b) by 0 days.

(21) Appl. No.: 13/657,756

(22) Filed: Oct. 22, 2012

Related U.S. Application Data

(60) Provisional application No. 61/549,446, filed on Oct. 20, 2011.

(51) Int. Cl.
*A61G 19/00* (2006.01)

(52) U.S. Cl.
CPC ..... *A61G 19/00* (2013.01)

(58) Field of Classification Search
USPC ..... 27/32–34, 26, 30; 414/460
See application file for complete search history.

(56) References Cited

U.S. PATENT DOCUMENTS

| | | | | | |
|---|---|---|---|---|---|
| 1,755,170 | A * | 4/1930 | Baker | 27/32 |
| 2,008,444 | A * | 7/1935 | Goodsman | 254/285 |
| 2,018,277 | A * | 10/1935 | Moore | 27/30 |
| 2,031,175 | A * | 2/1936 | Moore | 27/30 |
| 2,039,464 | A * | 5/1936 | Troup | 254/324 |
| 2,100,582 | A * | 11/1937 | Williams | 27/32 |
| 2,147,858 | A * | 2/1939 | Parker | 27/30 |
| 2,163,173 | A * | 6/1939 | Haase | 27/32 |
| 2,201,057 | A * | 5/1940 | Smetana | 27/26 |
| 2,249,687 | A * | 7/1941 | Eshleman | 27/32 |
| 2,520,515 | A * | 8/1950 | Spriggs et al. | 27/32 |
| 4,413,390 | A * | 11/1983 | Blaese et al. | 27/32 |
| 2012/0084953 | A1 * | 4/2012 | Herridge et al. | 27/32 |

* cited by examiner

*Primary Examiner* — William Miller
(74) *Attorney, Agent, or Firm* — Hamilton IP Law, PC; Jay R. Hamilton; Charles A. Damschen

(57) ABSTRACT

In one embodiment of a positioner, two opposing end beams may be cooperatively engaged with two opposing side beams. A first lowering unit may be cooperatively engaged with either a first end beam or first ends of the two opposing side beams. A second lowering unit may be cooperatively engaged with either a second end beam or second ends of the two opposing side beams. Legs and leg extensions may be cooperatively engaged at either end of either end beam, and pads may be placed on the distal ends of each leg extension. Actuators corresponding to each leg and leg extension may be in communication with a control unit to control the position of each actuator. Lateral extensions may be engaged with each end beam.

4 Claims, 11 Drawing Sheets

POSITIONER

CROSS REFERENCE TO RELATED APPLICATIONS

Applicant claims priority from provisional U.S. Patent App. No. 61/549,446 filed on Oct. 20, 2011, which is incorporated by reference herein in its entirety.

FIELD OF INVENTION

The present invention relates to a positioner and uses thereof, and more specifically, to a positioner configured to properly position objects with respect to a cavity.

STATEMENT REGARDING FEDERALLY SPONSORED RESEARCH OR DEVELOPMENT

No federal funds were used to develop or create the invention disclosed and described in the patent application.

REFERENCE TO SEQUENCE LISTING, A TABLE, OR A COMPUTER PROGRAM LISTING COMPACT DISK APPENDIX

Not Applicable

BRIEF DESCRIPTION OF THE FIGURES

In order that the advantages of the invention will be readily understood, a more particular description of the invention briefly described above will be rendered by reference to specific embodiments illustrated in the appended drawings. Understanding that these drawings depict only typical embodiments of the invention and are not therefore to be considered limited of its scope, the invention will be described and explained with additional specificity and detail through the use of the accompanying drawings.

DETAILED DESCRIPTION - LISTING OF ELEMENTS

Figure 1:
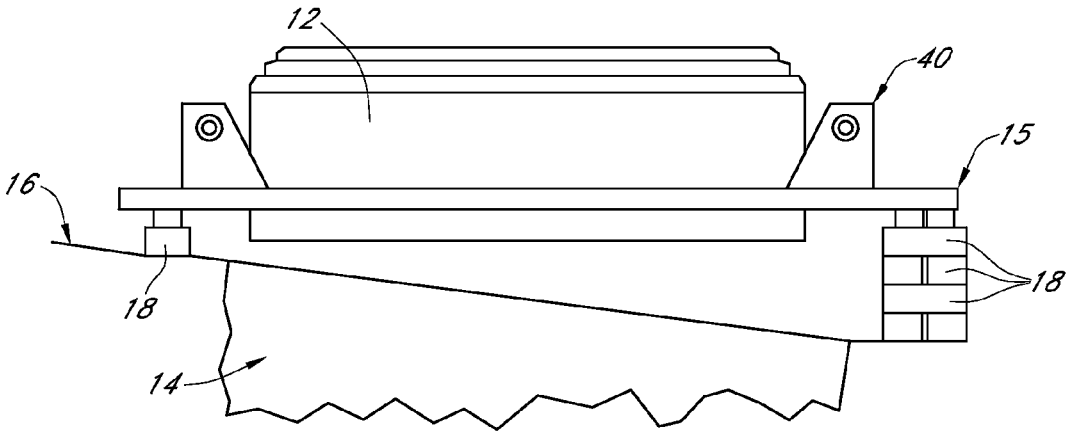
FIG. 1 provides a side view of a vault positioned adjacent a hole using a lifter as found in the prior art.

| ELEMENT DESCRIPTION | ELEMENT # |
|---|---|
| Positioner | 10 |
| Vault | 12 |
| Hole | 14 |
| Plank | 15 |
| Ground surface | 16 |
| Block | 18 |
| End beam | 20 |
| Lateral extension | 21 |
| Horizontal member | 21a |
| Control unit | 22 |
| Main tube | 23 |
| Receiver | 24 |
| Handle | 25 |
| Leg | 26 |
| Leg extension | 26a |
| Side beam coupler | 27 |
| Pad | 28 |
| Side beam | 30 |
| Lowering unit pad | 32 |
| Pad wall | 32a |
| Coupler receiver | 34 |
| Lowering unit | 40 |
| Bar | 42 |
| Receiver | 44 |
| Roller stand | 50 |
| Cross member | 52 |
| Side member | 54 |
| Roller | 56 |
| Rail shelf | 60 |
| Skirt | 62 |

DETAILED DESCRIPTION OF AN ILLUSTRATIVE EMBODIMENT

Before the various embodiments of the present invention are explained in detail, it is to be understood that the invention is not limited in its application to the details of construction and the arrangements of components set forth in the following description or illustrated in the drawings. The invention is capable of other embodiments and of being practiced or of being carried out in various ways. Also, it is to be understood that phraseology and terminology used herein with reference to device or element orientation (such as, for example, terms like “front”, “back”, “up”, “down”, “top”, “bottom”, and the like) are only used to simplify description of the present invention, and do not alone indicate or imply that the device or element referred to must have a particular orientation. In addition, terms such as “first”, “second”, and “third” are used herein and in the appended claims for purposes of description and are not intended to indicate or imply relative importance or significance.

Referring now to the drawings, wherein like reference numerals designate identical or corresponding parts throughout the several views, FIG. 1 provides a side view of a vault 12 positioned over a hole 14 using a lowering unit 40 as found in the prior art. Generally, to lower a vault 12 into a hole 14, blocks 18 are first placed on the ground surface 16 at two ends of the hole 14 or at the four corners thereof. Planks 15 running along the length of the vault 12 may then be placed on the blocks 18, and additional blocks 18 may be added and/or removed to that the two planks 15 are substantially level and at the same height. The planks 15 support two lowering units 40 positioned adjacent either end of each plank 15, and are generally oriented perpendicular with respect to the planks 15. The lowering units 40 cooperate to secure the vault 12 and are operable to lower the vault 12 into the hole 14, typically via a plurality of cables and/or straps (neither shown) engaging the bottom of the vault 12. As the prior art methods and structures for properly positioning and lowering a vault 12 into a hole 14 are well known to those skilled in the art, such methods and structures will not be described further herein for purposes of brevity.

Figure 2:
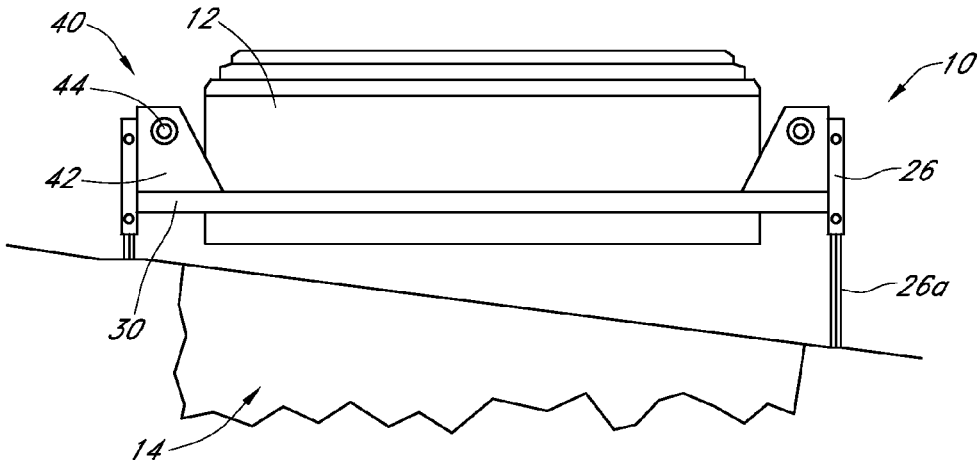
FIG. 2 provides a side view of a vault positioned adjacent a hole using a first embodiment of a positioner.
Figure 3:
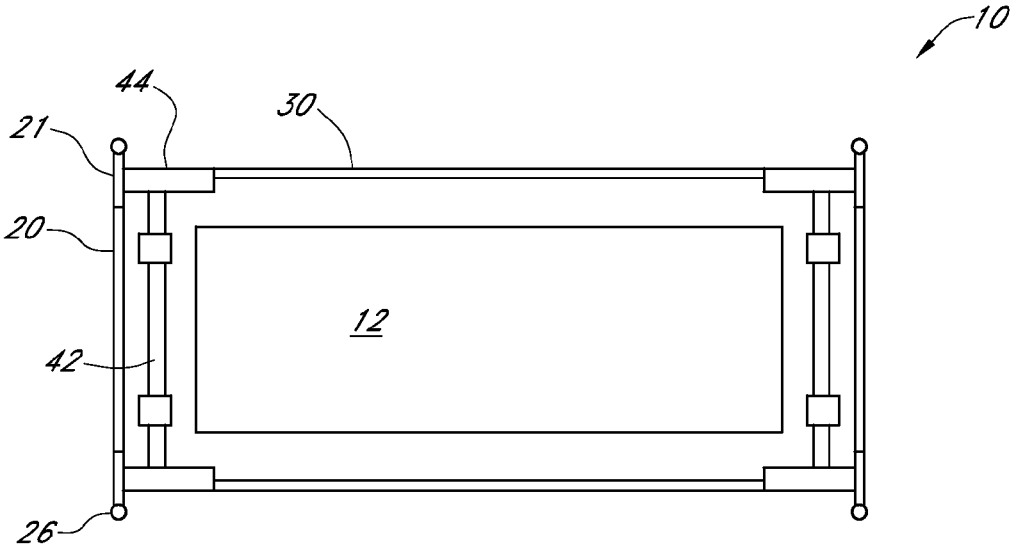
FIG. 3 provides a top view of a vault and the first embodiment of a positioner as shown in FIGS. 1 & 2.
Figure 4:
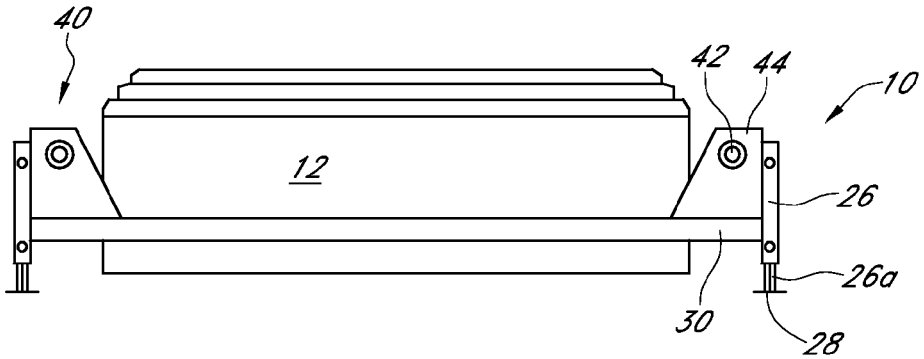
FIG. 4 provides a top view of a vault and the first embodiment of a positioner as shown in FIGS. 1-3.

A first embodiment of a positioner 10 is shown adjacent a hole 14 from a side view in FIG. 2. The hole 14 and ground surface 16 shown in FIG. 2 is identical to those shown in FIG. 1 to provide a direct comparison between the positioner 10 disclosed herein and the prior art. The first illustrative embodiment of a positioner 10 generally may include two end beams 20 engaged with two side beams 30. The positioner 10 may be configured such that the two end beams 20 are generally perpendicular to the two side beams 30, as best shown in FIG. 3, which provides a top view of a vault 12 engaged with the first illustrative embodiment of the positioner 10.

Figure 5:
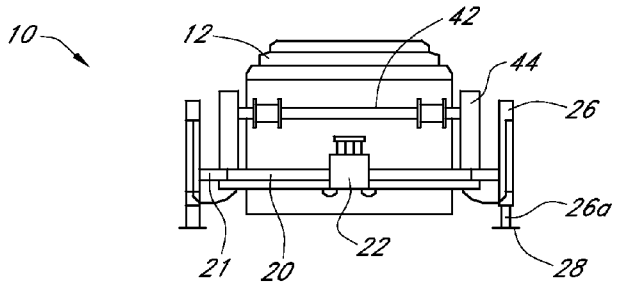
FIG. 5 provides a top view of a vault and the first embodiment of a positioner as shown in FIGS. 1-4.

The end beams 20 may be configured with lateral extensions 21 on either end thereof, which lateral extensions 21 are described in detail below. A leg 26 may be engaged with each lateral extension 21, a first embodiment of which is best shown in FIG. 5, which provides an end view of the first illustrative embodiment of the positioner 10. A let extension 26*a* may protrude downward from each leg 26, and a pad 28 may be engaged with the distal end of each leg extension 26*a*. Each leg 26 may include an actuator (not shown) positioned in the interior of the leg 26, such that extending the actuator causes the leg extension 26*a* to move out from the corresponding leg 26 and contracting the actuator causes the leg extension 26*a* to move toward the corresponding leg 26 in a telescopic fashion. Alternatively, the leg extensions 26*a* may be manually adjusted with respect to the corresponding leg 26.

A control unit 22 may be in communication with each actuator. The first illustrative embodiment of the positioner 10 shows the control unit 22 engaged to one of the end beams 20, but the scope of the positioner 10 is not so limited, and the control unit 22 may be positioned in any convenient location without departing from the spirit and scope of the positioner 10 as disclosed herein. The source of power for manipulating the actuators may be any suitable power source, including but not limited to compressed air, pressurized fluid, electricity, and/or combinations thereof. It is contemplated that an external source of power (e.g., electrical energy outlet, prime mover) may be in communication with the control unit 22 so that in certain embodiments the positioner 10 is not required to have an integral power source. It is contemplated that the necessary conduit (e.g., hoses, wires, etc.) may be routed through the end and/or side beams 20, 30 to protect the conduit and for aesthetic purposes. It is contemplated that for an embodiment of the positioner 10 for use with vaults 12, wherein the leg extensions 26*a* utilize hydraulic actuators, a two-inch fluid conduit will suffice from the control unit 22 to each respective actuator and from the power source to the control unit.

In the first illustrative embodiment, the user may manipulate the position of each leg extension 26*a* with respect to the corresponding leg 26 independently so that the legs 26 and leg extensions 26*a* may be used to level the positioner 10 regardless of the contour of the ground surface 16. Additionally, individual level indicators may be placed at strategic points on the positioner 10, such as one each end beam 20 and side beam 30, for accuracy. It is contemplated that a sheet, curtain, or other structure may be positioned around the positioner 10 to cover/hide the end beams 20, side beams 30, lowering units 40, and associated elements for aesthetic purposes.

The lateral extensions 21 may allow the user to adjust the distance between two legs 26 and leg extensions 26*a* (i.e., adjust the width of the positioner 10). Any suitable structure and/or method may be used to accomplish this, but in the illustrative embodiment the lateral extensions 21 associated with one end beam 20 may simply telescope with respect to that end beam 20 in a manner akin to that in which the leg extensions 26*a* telescope with respect to the corresponding leg 26. The lateral extensions 21 may be actuated or the manipulation thereof may be manual. Accordingly, the positioner 10 may be adjusted to accommodate a vast array of holes 14 having various dimensions.

A lowering unit 40 may be engaged with either end beam 20, as shown in FIGS. 2-5, for the first illustrative embodiment of the positioner 10. The lowering unit 40 may be that found in the prior art, or it may be an alternative design. Generally, the lower unit 40 functions to lower the vault 12 with respect to the end beams 20 and side beams 30 into the hole 14. Accordingly, any lowering unit 40 capable of performing such a function may be used with the positioner 10 without departing from the spirit and scope thereof.

The first illustrative embodiment may include a lowering unit comprising a rotatable bar 42 and a lowering receiver 44 at either end of the bar 42. Generally, cables (not shown) are affixed to each bar 42 and run the length of the vault 12 on the underside thereof. The receivers 44 may be rigidly affixed to their respective end beams 20, such that the weight of the vault 12 is transferred from the cables, to the end and side beams 20, 30, which transfer the weight to the legs 26, leg extensions 26*a*, and pads 28 (if present in that embodiment of the positioner 10). Alternatively, each receiver may be rigidly affixed to their respective side beams 30, the side beams 30 may simply rest on each end beam 20.

To lower the vault 12 into a hole 14, the bar 42 of one lowering unit 40 rotates in a first direction with respect to the corresponding receivers 44 and the bar of the other lowering unit 40 rotates in a second direction with respect to its corresponding receivers 44. To raise the vault 12, the process is reversed. Because such lowering units 40 are well known to those skilled in the art, they will not be described further herein for purposes of brevity. The power source required to rotate each bar 42 may be the same as that used for the actuation of any elements disclosed herein, or it may be a separate power source. It is contemplated that an electric winch may be especially suitable for certain applications of the positioner 10, but the selection of which is in no way limiting. Additionally, the lowering units 40 may be manually operated such that no power source other than the user's input is required.

In another embodiment of the positioner 10 not shown herein, the side beams 30 telescope such that the respective lengths thereof may be adjustable. Such an embodiment allows the user to accommodate an even wider array of hole 14 sizes. As with the lateral extensions 21, such telescoping side beams 30 may be actuated or manually adjusted. It is estimated that the positioner 10 disclosed herein will reduce the time required to properly position a vault 12 over a hole 14 by 1-2 hours compared with the prior art shown in FIG. 1.

Figure 11:
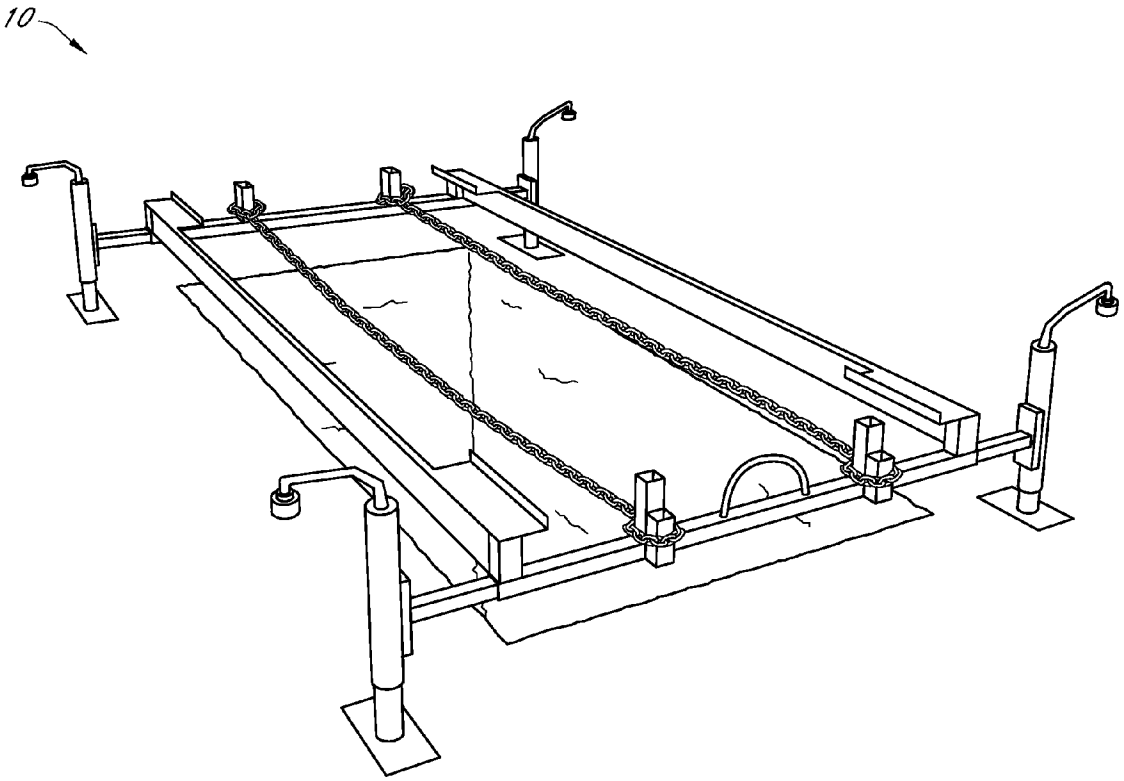
FIG. 11 is a perspective view of a second embodiment of a positioner placed adjacent a hole.
Figure 12:
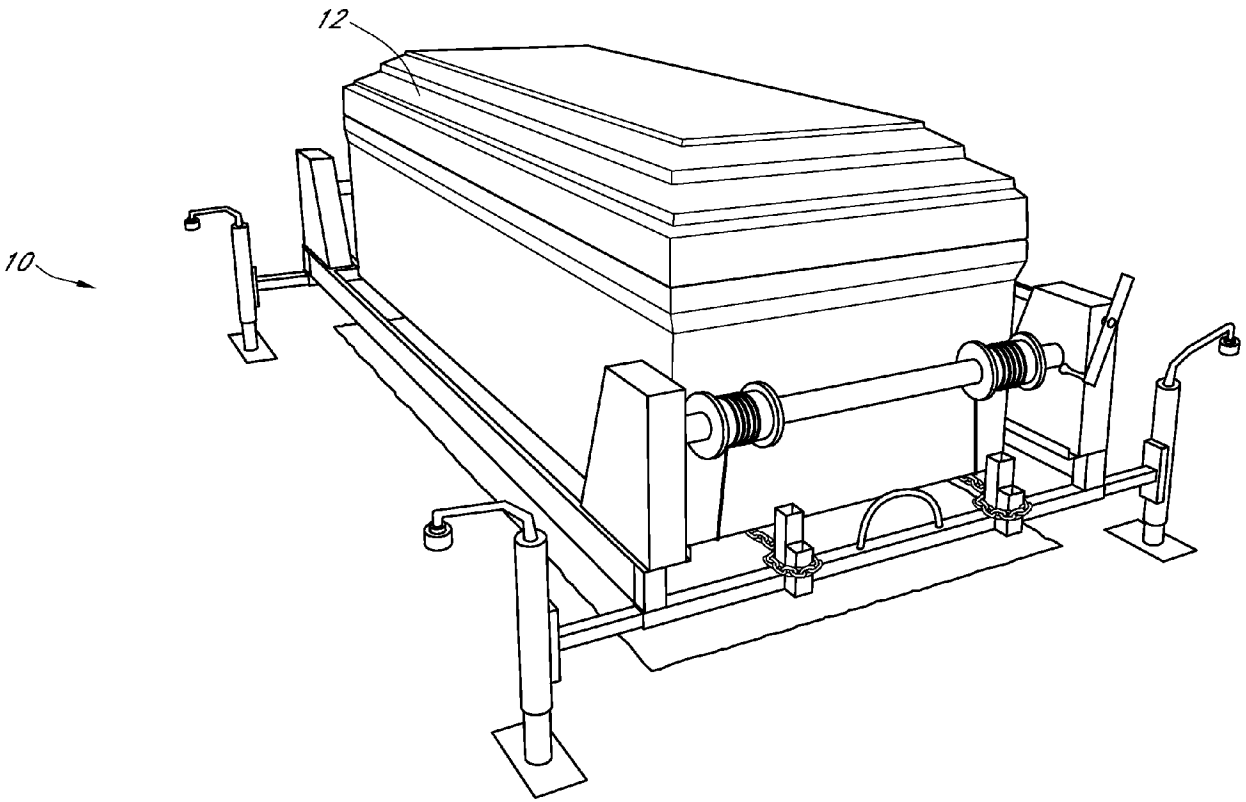
FIG. 12 is a perspective view of the positioner shown in FIG. 11 with a vault and a lowering unit adjacent the positioner.

A second illustrative embodiment of a positioner 10 is shown in perspective placed over a hole 14 in FIG. 11. The same positioner 10 is shown in FIG. 12 with a lowering unit 40 engaged with the positioner 10 at either end thereof and a vault 12 placed on the lowering unit 40. As with the first illustrative embodiment, the second illustrative embodiment of the positioner 10 may include two end beams 20 (shown in FIG. 14) engaged with two side beams 30. The side beams 30 may be oriented generally parallel with one another and perpendicular with respect to the end beams 20 and vice versa.

Figure 6A:
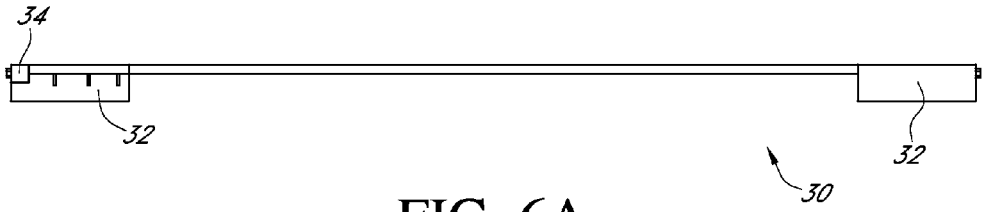
FIG. 6A is a top view of a second embodiment of a side beam that may be used with a positioner.
Figure 6B:
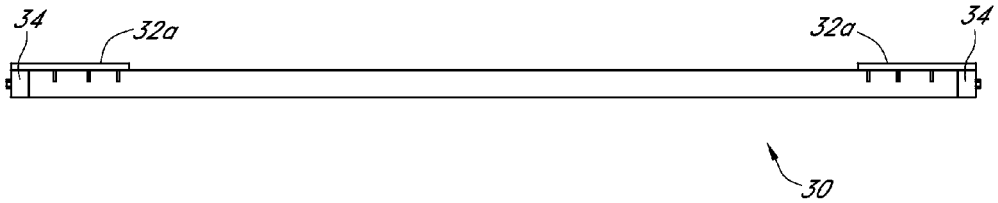
FIG. 6B is a side view of the second embodiment of a side beam shown in FIG. 6A.

One embodiment of a side beam 30 that may be used with the positioner 10 shown in FIGS. 10-14 is shown in FIGS. 6A & 6B. FIG. 6A provides a top view of the side beam 30 and FIG. 6B provides a side view thereof. As shown, a side beam 30 may include a lowering unit pad 32 having a pad wall 32*a* extending upward therefrom. In this embodiment, the lowering unit 40 by be engaged with the side beams 30 via the lowering unit pads 32. Accidental dislocation of the lowering units 40 may be mitigated by the pad wall 32*a*, which may form a mechanical obstruction to movement of the lowering unit 40 with respect to the positioner 10 in at least one dimension. FIG. 12 shows a lowering unit 40 engaged with a positioner 10 via the lowering unit pads 32 on two side beams 30.

The embodiment of a side beam 30 shown in FIGS. 6A & 6B may also include a coupler receiver 34 rigidly affixed to either end of the side beam 30. The coupler receiver 34 may be configured to secure each side beam 30 to a respective end beam 20 via an interface between the respective coupler receiver 34 and a corresponding side beam coupler 27 engaged with one of the end beams 20, as described in detail below.

Figure 7:
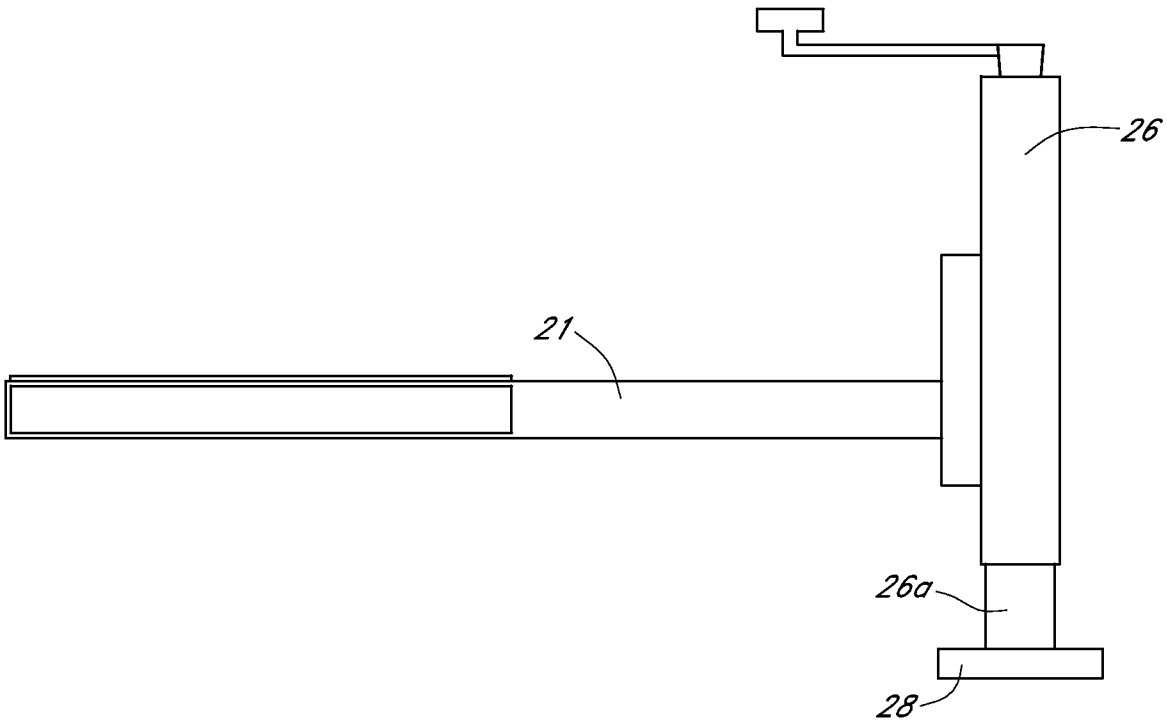
FIG. 7 is a side view of a second embodiment of a lateral extension that may be used with a positioner.
Figure 8A:
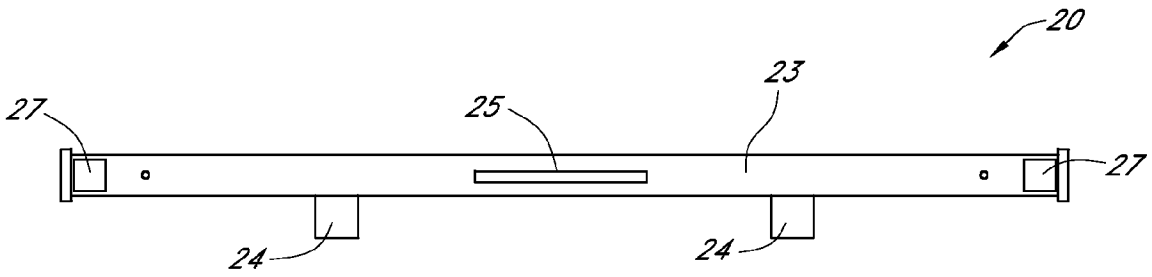
FIG. 8A is a top view of a second embodiment of an end beam that may be used with a positioner.
Figure 8B:
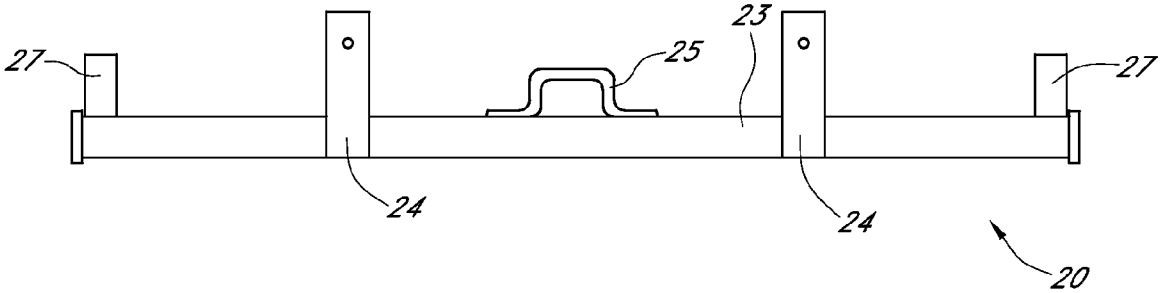
FIG. 8B is a side view of a second embodiment of a lateral extension shown in FIG. 8A.
Figure 13:
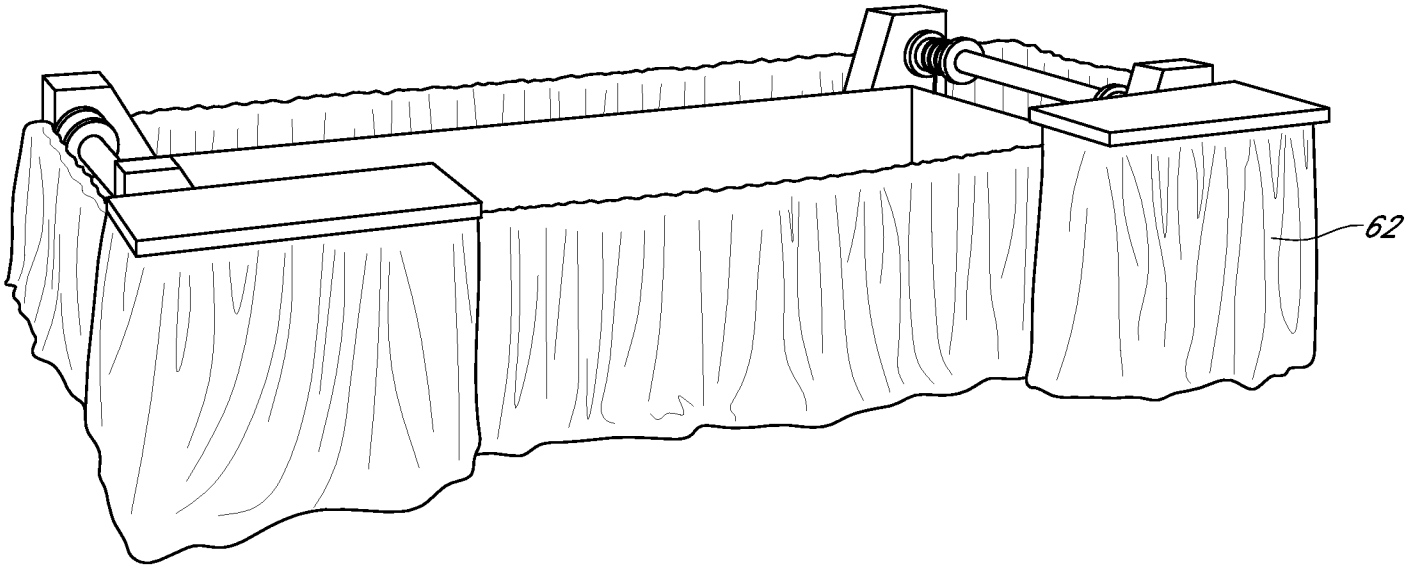
FIG. 13 is a perspective view of the positioner shown in FIGS. 11 & 12 with a skirt placed around the periphery of the positioner.
Figure 14:
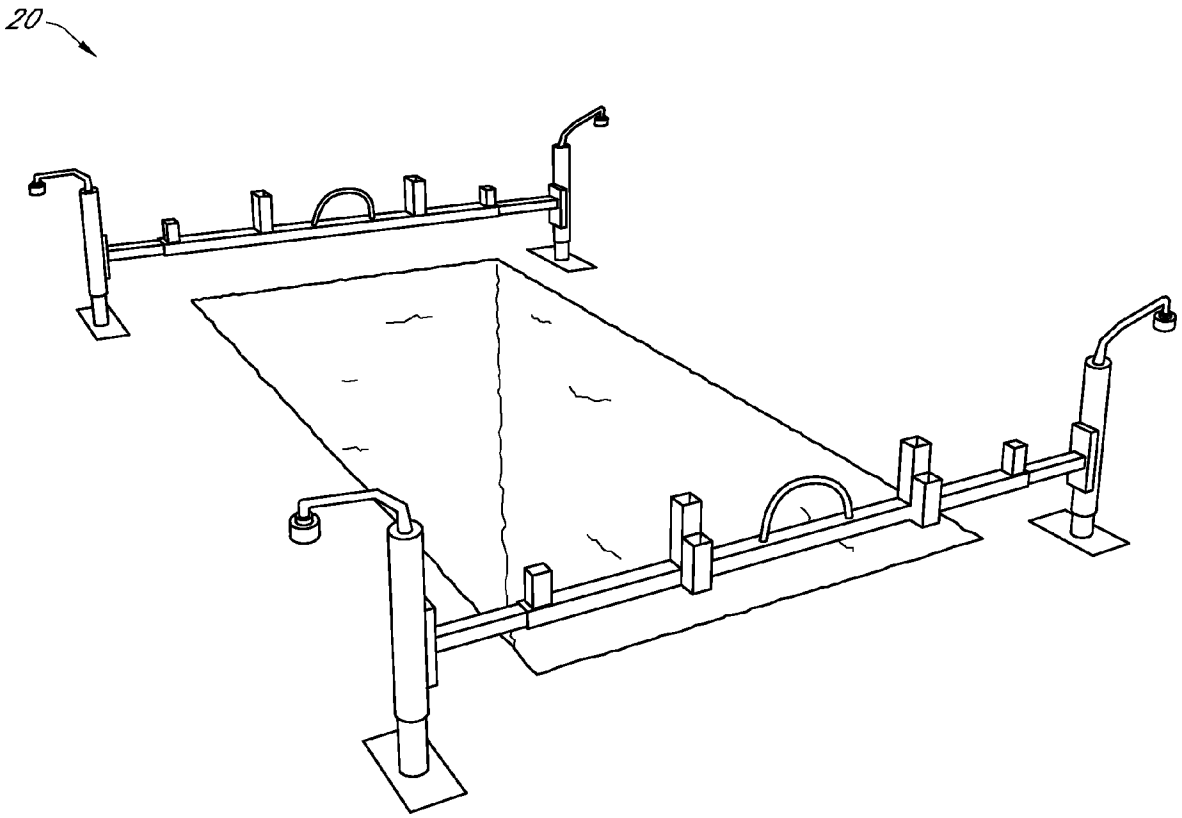
FIG. 14 is a perspective view of the end beams from the second embodiment of the positioner shown in FIG. 11.

One embodiment of an end beam 20 that may be used with the positioner 10 shown in FIGS. 10-14 is shown in FIGS. 8A, 8B, and 14. FIG. 8A provides a top view of the end beam 20 and FIG. 8B provides a side view thereof. As shown, an end beam 20 may include a main tube 23 into which a respective lateral extension 21 may be inserted at each end of the main tube 23. An embodiment of a lateral extension 21 is shown in FIG. 7, which embodiment thereof may be used with the embodiment of an end beam shown in FIGS. 8A & 8B. A handle 25 may be affixed to each main tube 23 to aid in transport and/or adjusting the position of each end beam 20.

The lateral extension 21 may be configured to fit within a portion of the end beam 20 such that certain forces applied to the end beam 20 are transferred to the lateral extension 21, such as downward forces due to gravity. A leg 26 may be coupled to the distal end of the lateral extension 21 as shown in FIGS. 7, 11, 12, and 14. A leg extension 26*a* may be moveable with respect to the leg 26 to adjust the height of the lateral extension 21 from the ground surface 16. A pad 28 may be engaged with the distal end of the leg extension 26*a* also as shown. In the illustrative embodiment of a leg 26 and leg extension 26*a* shown in FIGS. 7, 11, 12, and 14, the leg 26 and leg extension 26*a* is generally configured as a manual jack, the height of which may be adjusted via a user turning a jack handle in a specific direction. However, as previously disclosed herein, the scope of the leg 26 and/or leg extension 26*a* is not so limited and may apply to numerous structures, including other manually adjusted structures and/or externally powered structures.

The position of a lateral extension 21 may be secured with respect to an end beam 20 along its longitudinal axis via positioning a pin (not shown) into one or more apertures in the lateral extension 21 corresponding to one or more apertures in the end beam 20. In this manner, each lateral extension 21 may be allowed to telescope with respect to the end beam 20 in a secure manner such that the width of the second illustrative embodiment of the positioner 10 may be adjusted.

A side beam coupler 27 may be affixed to either end of the main tube 23 and extend upward therefrom. In the second illustrative embodiment of the positioner 10, each side beam 30 may be engaged with each end beam 20 via the coupler receiver 34 affixed to a side beam 30 and a side beam coupler 27. In the second illustrative embodiment, the coupler receiver 34 (female end) fits over the side beam coupler 27 (male end). However, any suitable structure and/or method may be used to engage the side beams 30 and end beams 20, and the positioner 10 is in no way limited by the specific structure and/or method used to engage the side beams 30 and end beams 20 with one another. Corresponding apertures in the coupler receiver 34 and side beam coupler 27 and a pin may be used to ensure the end beam 20 and side beam 30 are not inadvertently disengaged from one another.

Figure 9A:
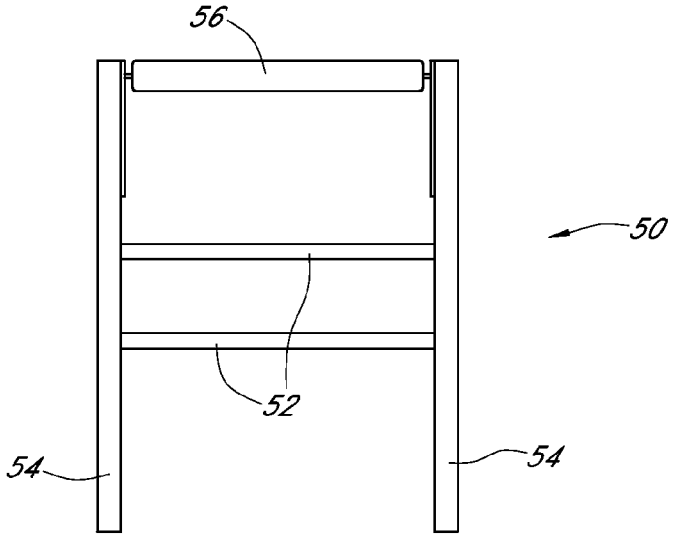
FIG. 9A is an end view of one embodiment of a roller stand that may be used with a positioner.
Figure 9B:
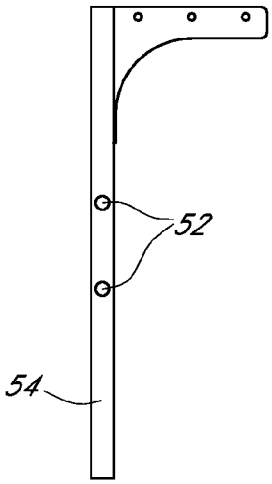
FIG. 9B is a side view of the roller stand shown in FIG. 9A.
Figure 9C:
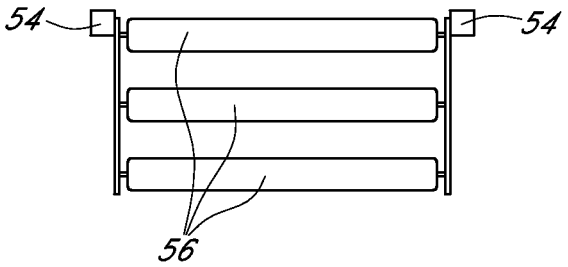
FIG. 9C is a top view of the roller stand shown in FIGS. 9A & 9B.
Figure 10:
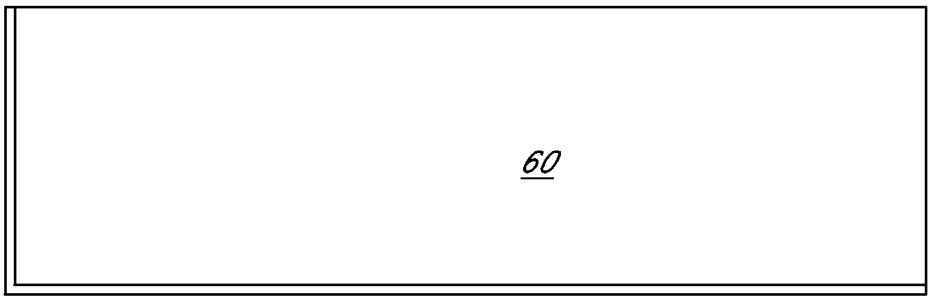
FIG. 10 is a top view of one embodiment of a rail shelf that may be used with a positioner.

One or more receivers 24 may be affixed to the main tube 23. The receivers 24 may be configured to provide an engagement point between an end beam 20 and a roller stand 50. One embodiment of a roller stand 50 is shown in FIGS. 9A-9C. The embodiment of a roller stand 50 shown in FIGS. 9A-9C may include two side members 54 coupled to one another via at least one cross member 52 and at least one roller 56. The distal ends of the side members 54 may fit into the receivers 24 and secured thereto via one or more corresponding apertures in the side members 54 and receivers 24 and a pin passing therethrough. Accordingly, the height of the roller stand 50 with respect to the end beam 20 may be adjusted via a plurality of apertures formed in the side member 54. It is contemplated that the roller stand 50 will facilitate placement of a casket (not shown) on a casket lowering device, which may be placed above the positioner 10 as shown in FIG. 13.

A system of fabric supports may be engaged with the positioner 10 at strategic locations to facilitate placement of skirts 62 around the periphery of the positioner 10, as best shown in FIG. 13. The placement of skirts may increase the aesthetic appeal of the burial site. A rail shelf 60, configured substantially as a flat, rectangular-shaped metal plate, may be engaged with each corner of the positioner 10 via any suitable engagement structure and/or method (e.g., magnets, mechanical fasteners, etc.).

The optimal dimensions of the end beam 20, lateral extension 21, leg 26, leg extension 26*a*, pad 28, side beam 30, bar 42, and/or lowering receiver 44 will vary from one embodiment of the positioner 10 to the next, and are therefore in no way limiting to the scope thereof. The various elements of the positioner 10 may be formed of any material that is suitable for the application for which the positioner 10 is used. Such materials include but are not limited to rubber, silicon, other polymers, metals, metallic alloys, cellulosic materials, and/or combinations thereof.

Although the specific embodiments pictured and described herein pertain to a positioner 10 for use with a hole 14 and vault 12, other positioners 10 may be employed for other uses. Accordingly, the scope of the positioner 10 is in no way limited by the specific structure the positioner 10 is used to raise/lower.

Having described the preferred embodiment, other features, advantages, and/or efficiencies of the positioner 10 will undoubtedly occur to those versed in the art, as will numerous modifications and alterations of the disclosed embodiments and methods, all of which may be achieved without departing from the spirit and scope of the positioner 10. It should be noted that the positioner 10 is not limited to the specific embodiments pictured and described herein, but are intended to apply to all similar apparatuses for efficiently placing a structure. Modifications and alterations from the described embodiments will occur to those skilled in the art without departure from the spirit and scope of the positioner 10.

The invention claimed is:

1. A positioner comprising:

a. a first end beam;

b. a second end beam;

c. a first side beam, wherein a first end of said first side beam is cooperatively engaged with said first end beam and wherein a second end of said first side beam is cooperatively engaged with said second end beam;

d. a second side beam, wherein a first end of said second side beam is cooperatively engaged with said first end beam and wherein a second end of said second side beam is cooperatively engaged with said second end beam;

e. a first lowering unit cooperatively engaged with said first ends of said first and second side beams, wherein said first lowering unit comprises a bar and a receiver, wherein said bar is rotatably mounted to said receiver;

f. a second lowering unit cooperatively engaged with said second ends of said first and second side beams;

g. a first lateral extension cooperatively engaged with said first end beam;

h. a second lateral extension cooperatively engaged with said second end beam;

i. a first leg cooperatively engaged with said first lateral extension;

j. a first leg extension cooperatively engaged with said first leg;

k. a second leg cooperatively engaged with said second lateral extension;

l. a second leg extension cooperatively engaged with said second leg;

m. a first pad cooperatively engaged with the distal end of said first leg extension;

n. a third lateral extension cooperatively engaged with said first end beam;

o. a fourth lateral extension cooperatively engaged with said second end beam;

p. a third leg cooperatively engaged with said third lateral extension;

q. a third leg extension cooperatively engaged with said third leg;

r. a fourth leg cooperatively engaged with said fourth lateral extension;

s. a fourth leg extension cooperatively engaged with said fourth leg, t. a first actuator cooperatively engaged with said first leg and said first leg extension;

u. a second actuator cooperatively engaged with said second leg and said second leg extension;

v. a third actuator cooperatively engaged with said third leg and said third leg extension;

w. a fourth actuator cooperatively engaged with said fourth leg and said fourth leg extension; and x. a control unit, wherein said control unit is used to manipulate the relative positions of said first, second, third, and fourth actuators.

2. A positioner comprising:

a. a first end beam comprising:

i. a main tube having first and second ends;

ii. a first lateral extension engaged with said first end of said main tube, said first lateral extension including a leg and a leg extension extending from said leg, wherein said leg extension is configured in a telescoping arrangement with said leg such that said leg extension protrudes outward from said leg, and wherein a distance from the distal end of said leg and the distal end of said leg extension is adjustable via said telescoping arrangement;

iii. a second lateral extension engaged with said second end of said main tube said second lateral extension including a leg and a leg extension extending from said leg, wherein said leg extension is configured in a telescoping arrangement with said leg such that said leg extension protrudes outward from said leg, and wherein a distance from the distal end of said leg and the distal end of said leg extension is adjustable via said telescoping arrangement;

iv. a first and second side beam coupler engaged with said main tube;

b. a second end beam comprising;

i. a main tube having first and second ends;

ii. a first lateral extension engaged with said first end of said main tube, said first lateral extension including a leg and a leg extension extending from said leg, wherein said leg extension is configured in a telescoping arrangement with said leg such that said leg extension protrudes outward from said leg, and wherein a distance from the distal end of said leg and the distal end of said leg extension is adjustable via said telescoping arrangement;

iii. a second lateral extension engaged with said second end of said main tube said second lateral extension including a leg and a leg extension extending from said leg, wherein said leg extension is configured in a telescoping arrangement with said leg such that said leg extension protrudes outward from said leg, and wherein a distance from the distal end of said leg and the distal end of said leg extension is adjustable via said telescoping arrangement;

iv. a first and second side beam coupler engaged with said main tube;

c. a first side beam having first and second ends, said first side beam comprising:

i. a first and second lowering unit pad secured to either end of said first side beam;

ii. a first and second coupler receiver secured to either end of said first side beam, wherein said first coupler receiver is cooperatively engageable with said first side beam coupler of said first end beam and said second coupler receiver is cooperatively engageable with said said first side beam coupler of said second end beam;

d. a second side beam having first and second ends, said second side beam comprising:

i. a first and second lowering unit pad secured to either end of said second side beam; and, ii. a first and second coupler receiver secured to either end of said second side beam, wherein said first coupler receiver is cooperatively engageable with said second side beam coupler of said first end beam and said second coupler receiver is cooperatively engageable with said second side beam coupler of said second end beam.

3. The positioner according to claim 2 wherein said first end beam further comprises a receiver engaged therewith.

4. The positioner according to claim 3 further comprising a roller stand, wherein said roller stand is engageable with said positioner via said receiver.

* * * * *